US010475400B2

(12) United States Patent
Offredi

(10) Patent No.: US 10,475,400 B2
(45) Date of Patent: Nov. 12, 2019

(54) DIGITAL DISPLAY

(71) Applicant: BAE SYSTEMS plc, London (GB)

(72) Inventor: Matthew Frank Offredi, Rochester-Kent (GB)

(73) Assignee: BAE SYSTEMS PLC (GB)

( * ) Notice: Subject to any disclaimer, the term of this patent is extended or adjusted under 35 U.S.C. 154(b) by 60 days.

(21) Appl. No.: 15/561,857

(22) PCT Filed: Mar. 22, 2016

(86) PCT No.: PCT/GB2016/050803
§ 371 (c)(1),
(2) Date: Sep. 26, 2017

(87) PCT Pub. No.: WO2016/156802
PCT Pub. Date: Oct. 6, 2016

(65) Prior Publication Data

US 2018/0122308 A1 May 3, 2018

(30) Foreign Application Priority Data

Mar. 27, 2015 (EP) ..... 15275089

(51) Int. Cl.
*G09G 3/34* (2006.01)
*G09G 3/20* (2006.01)

(52) U.S. Cl.
CPC ..... *G09G 3/346* (2013.01); *G09G 3/2025* (2013.01); *G09G 3/2037* (2013.01);
(Continued)

(58) Field of Classification Search
CPC combination set(s) only.
See application file for complete search history.

(56) References Cited

U.S. PATENT DOCUMENTS 5,798,743 A * 8/1998 Bloom ..... G09G 3/2018 345/692
6,189,064 B1 * 2/2001 MacInnis ..... G06T 9/00 345/440

(Continued)

FOREIGN PATENT DOCUMENTS

EP 1091343 A2 4/2001
JP 2011188457 A 9/2011

(Continued)

OTHER PUBLICATIONS

International Search Report and Written Opinion for Patent Application No. PCT/GB2016/050803, dated May 24, 2016. 12 pages.

(Continued)

*Primary Examiner* — Kwin Xie
(74) *Attorney, Agent, or Firm* — Finch & Maloney PLLC

(57) ABSTRACT

A method for controlling a digital display device and a digital display system implementing the method are provided in which a required luminance level for a pixel is controlled according to a store provided for each pixel, the contents of which indicate the number of discrete display update periods during an image refresh period for the pixel for which the pixel is to be illuminated to achieve the required luminance level, the content being read at each update period and the content determining whether the pixel is to be illuminated for that update period, the content being updated at each update period for which the pixel is illuminated to indicate that the number of update cycles for which the pixel is to be illuminated is thereby reduced by one and wherein the content of the store may be updated at any update cycle in response to changes in required pixel luminance level indicated by received image data.

18 Claims, 4 Drawing Sheets

(52) U.S. Cl.
CPC ..... *G09G 2310/0286* (2013.01); *G09G 2310/0297* (2013.01); *G09G 2310/061* (2013.01); *G09G 2310/08* (2013.01); *G09G 2320/0626* (2013.01)

(56) References Cited

U.S. PATENT DOCUMENTS

2001/0043172 A1* 11/2001 McGrath ..... G09G 3/22 345/75.2
2004/0233150 A1* 11/2004 Guttag ..... G09G 3/34 345/87
2008/0007576 A1* 1/2008 Ishii ..... G09G 3/2025 345/691
2008/0024677 A1* 1/2008 Ohara ..... G02B 26/0833 348/720
2010/0045690 A1* 2/2010 Handschy ..... G09G 3/3629 345/549

FOREIGN PATENT DOCUMENTS

WO 2013140143 A1 9/2013
WO 2016156802 A1 10/2016

OTHER PUBLICATIONS

GB Intellectual Property Office Combined Search and Examination Report under Sections 17 and 18(3) for GB Patent Application No. 1604885.2 dated Sep. 14, 2016. 5 pages.
Extended European Search Report, pursuant to Rule 62 EPC, for EP Patent Application No. 15275089.9 dated Jul. 9, 2015. 8 pages.
International Preliminary Report on Patentability for Patent Application No. PCT/GB2016/050803, dated Oct. 12, 2017. 9 pages.

* cited by examiner

DIGITAL DISPLAY

This invention relates to digital displays and in particular, but not exclusively, to a method and apparatus for controlling the display of images in digital display devices, for example digital displays based upon a digital micro-mirror device (DMD), a liquid crystal display (LCD) device or a liquid crystal on silicon (LCOS) display device. However, the principles of operation of the present invention may be applied advantageously to other types of digital display device.

A DMD comprises an array of micro-mirrors which can be individually and selectively activated by controlling the angle at which they reflect incident light. An array of micro-mirrors corresponds to an array of pixels in an image to be displayed. In an 'on' state a mirror reflects light for displaying a pixel of an image and in an 'off' state the mirror reflects the light to a light dump. A DMD has an 'update period' which may vary from one type of device to another or may be selected by a system designer dependent on the required performance of the system. The DMD update period is the time period during which the micro-mirrors can be controlled to be switched to or held in either an 'on' state or an 'off' state. By way of example, a typical DMD update period may be between 200 μs and 600 μs so that each of the mirrors may be controlled to change state every 200 μs to 600 μs. A display is required to maintain each pixel of an image for a minimum period—an 'image refresh period' or 'frame period'—to allow proper perception by a human observer. An image refresh or frame period of 16 or 20 ms is typical and represents a time period less than the minimum period during which a human eye is able to perceive a change in pixel luminance or colour. Accordingly, the state of each pixel represented in the DMD can be changed many times during a refresh period and the eye will integrate the discrete periods of illumination to result in a single perceived luminance level over that period. For example, a DMD update period of 572 μs provides an opportunity to change the state of a micro-mirror up to 35 times during a refresh period of 20 ms. Different perceived illumination levels may be achieved using predetermined combinations of mirror states over those 35 DMD update periods.

Conventional methods for rendering an image by controlling the state of the micro-mirrors in a DMD device operate on a frame-by-frame basis, the image data required to define the pixels for the image in each frame being determined in time for the beginning of each 16 or 20 ms frame period. The pixel luminance and colour to be displayed in a given frame needs to be uploaded to a DMD 'driver' in time for the beginning of a respective frame period and a predetermined pattern of mirror modulation is applied by the DMD driver in respect of each pixel during that frame period to ensure that pixels of the required luminance and colour (if the image is a colour image) may be perceived by a viewer. However, one difficulty with this approach is that updates to an image to be displayed, for example adding a new element of a cursively drawn symbol to the image, cannot be introduced until the next 20 ms frame period. In some applications such a delay is unacceptable.

Various attempts have been made to introduce image updates during a frame period. One example of such an attempt is described in an international patent application by the present Applicant, published on 26 Sep. 2013 as WO 2013/140143, in which a dual image buffer arrangement is provided to enable new image portions to be 'plotted' into an image at a given DMD update cycle during one frame period and 'unplotted' at a corresponding DMD update cycle of the next frame period, with a respective pattern of DMD pixel modulation being applied to the affected pixels between plotting and unplotting to achieve the required overall pixel luminance.

In a first aspect, the present invention resides in a method for controlling a digital display device to display an image, by which method a perceived luminance level for a pixel in an image to be displayed is achieved by controlling a respective element of the display device to illuminate the pixel for a predetermined portion of a respective image refresh period, said portion being indicated by the content of a store provided in respect of the pixel, the content representing a number of discrete display device update periods of predetermined length within the image refresh period for the pixel during which the pixel is to be illuminated such that the pixel is illuminated for said portion of the image refresh period, wherein the content of the store at each update period determines whether the respective pixel is to be illuminated or not illuminated for that update period and the content of the store is updated at each update period for which the pixel is illuminated to indicate that the number of update periods for which the pixel is to be illuminated is reduced by one and wherein the content of the store may be updated at any update period to implement an update to the luminance level required for the pixel in response to received image data.

In one example embodiment, a pixel may be illuminated for a portion of an update cycle and the content of the store determines which of one or more predetermined display update cycles during the image refresh period for the pixel are designated for the purpose of illumination of the pixel for a respective portion of the update cycle, so enabling the perception of one or more fractional levels of pixel luminance.

In a particular example embodiment, four predetermined update cycles during an image refresh period for a pixel are reserved for the illumination of the pixel for a different respective portion of the update cycle, so providing for up to fifteen fractional levels of pixel luminance.

In a further example embodiment, the method further comprises the steps:

receiving image data defining luminance levels for pixels of an image to be displayed by the display device;

storing in a store provided for each pixel an indication of the number of update periods for which the pixel is to be fully illuminated;

retrieving the stored content for each pixel to be updated in the image during a given update period; and in the event that the retrieved content indicates that the pixel is to be illuminated for the given update period, controlling the display device to illuminate the pixel during the update period and updating the content of the store to indicate that the number of update periods for which the pixel is to be illuminated is reduced by one.

In another example embodiment, the store comprises a count-down timer value store for each pixel defining the number of update periods for which the pixel is to be illuminated and wherein updating the store at each update period comprises decrementing the stored time value for the pixel such that when the stored value reaches zero, the pixel will no longer be illuminated.

In an alternative implementation, the store comprises a shift register for each pixel of bit-length equal to the number of update periods in the image refresh period for the pixel, wherein the number of update periods for which the pixel is to be illuminated is indicated by the number of bits set in the shift register, and wherein updating the store at each update period comprises shifting the bits in the shift register by one position such that when a bit is read from the shift register, the respective pixel will be illuminated if the bit is set, or otherwise the pixel will no longer be illuminated.

In a further variant, any bit of the shift register may be updated at any update cycle in response to received image data causing an update to the required luminance level for the respective pixel.

In a second aspect, the present invention resides in a digital display system, comprising:

a digital display device for displaying an image; and a display controller arranged to control the digital display device to display pixels in an image at a required level of luminance by controlling a respective region of the display device to illuminate a pixel for a respective portion of an image refresh period for the pixel, wherein the display controller comprises:

an input for receiving image data defining luminance levels for one or more pixels in an image to be displayed or updated;

a processor arranged with access to a store provided for each pixel:

to receive image data from the input defining a required luminance level for a pixel;

to store in the store provided for the pixel an indication of a number of discrete display device update periods of predetermined length within the image refresh period for the pixel during which the pixel is to be illuminated such that the pixel is illuminated for a portion of the image refresh period corresponding to the required luminance level for the pixel;

to read the content of the store for each pixel at each update period and to generate an output to indicate which pixels are to be illuminated for the update period and which are not to be illuminated, in dependence upon the content of the respective pixel stores;

to update the content of the store for each pixel at each update period for which the content indicates that the pixel is to be illuminated to indicate that the number of update periods for which the pixel is to be illuminated is reduced by one; and to update the content of the store at any update period to implement an update to the luminance level required for the pixel in response to received image data, and means for receiving output from the processor and to cause the display device to illuminate pixels during a given display update period according to the output indications.

In an example embodiment of the system, a pixel may be illuminated for a portion of an update cycle and wherein the content of the store determines which of one or more predetermined display update cycles during the image refresh period for the pixel are designated for the purpose of illumination of the pixel for a respective portion of the update cycle, so enabling the perception of one or more fractional levels of pixel luminance.

In a particular example embodiment, four predetermined update cycles during an image refresh period for a pixel are reserved for the illumination of the pixel for a different respective portion of the update cycle, so providing for up to fifteen fractional levels of pixel luminance.

In another example embodiment of the system, the store comprises a count-down timer value store for each pixel defining the number of update periods for which the pixel is to be illuminated and wherein updating the store at each update period comprises decrementing the stored time value for the pixel such that when the stored value reaches zero, the pixel will no longer be illuminated.

In an alternative implementation, the store comprises a shift register for each pixel of bit-length equal to the number of update periods in the image refresh period for the pixel, wherein the number of update periods for which the pixel is to be illuminated is indicated by the number of bits set in the shift register, and wherein updating the store at each update period comprises shifting the bits in the shift register by one position such that when a bit is read from the shift register, the respective pixel will be illuminated if the bit is set, or otherwise the pixel will no longer be illuminated.

In a further variant, the processor is arranged with access to update any bit of the shift register at any update cycle in response to received image data causing an update to the required luminance level for the respective pixel.

In a third aspect, the present invention resides in a digital display device incorporating or associated with a controller arranged to implement the method according to any embodiment of the first aspect of the present invention.

In a fourth aspect, the present invention resides in a digital display device controllable according to the method defined according to any embodiment of the first aspect of the present invention.

The present invention aims to provide a much simplified approach to the modulation of DMD mirrors and to the management of an image buffer in an improved DMD controller to enable updates to an image to be introduced as they are required, beginning as soon as the next DMD update cycle. The present invention may be applied similarly to other types of digital display device, as would be apparent to a notional skilled person in the field.

Example embodiments of the present invention will now be described in more detail with reference to the accompanying drawings, of which:

Figure 1:
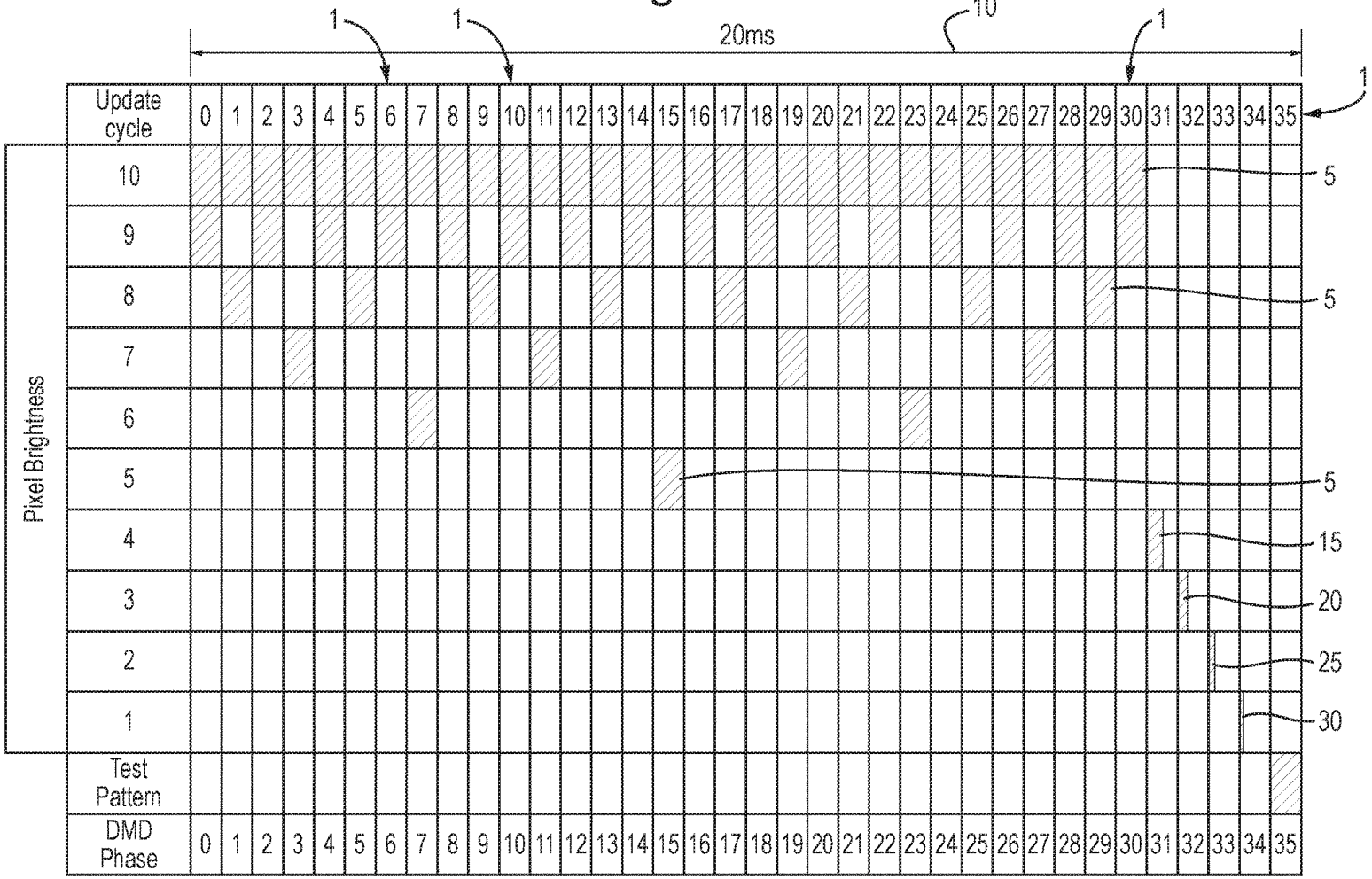
FIG. 1 shows a known DMD modulation scheme for achieving different pixel luminance levels based upon one of six luminance levels, combining selections of DMD update cycles during which the pixel is fully illuminated, combined with up to four DMD update cycles during which the pixel is illuminated over a different respective fraction of the cycle.

Referring initially to FIG. 1, a known example of a DMD mirror modulation scheme is shown for generating different pixel luminance levels for a given frame of a video image or of a still image in a display system using a DMD device. Different levels of pixel luminance are achieved during a given frame period by selecting of one of six luminance levels, '5' to '10', comprising combinations of 31 DMD update cycles 1 (0 to 30) during which the pixel is fully illuminated (i.e. illuminated for the all of an available period during the update cycle for which the mirror is actually in an 'on' state) and any combination of up to four 'fractional' pixel luminance levels, '1' to '4', achieved over 4 DMD update cycles (31-34) during which a pixel is illuminated for a different respective fraction of the available illumination time during the DMD update cycle. Under such a scheme, each DMD mirror may be set to be 'on' during particular DMD update cycles and 'off' otherwise, the sequence of 'on' periods required to achieve the perception of each luminance level being shown in FIG. 1 as shaded blocks 5. The eye of a viewer is able to perceive the pixel at a particular required luminance according to the proportion of a 20 ms 'frame period' or 'image refresh period' 10 during which the respective DMD mirror is (or mirrors are) 'on'. For a pixel luminance of less than level '5', the mirror will be set to 'on' for respective portions 15 (½), 20 (¼), 25 (⅛), 30 (1/16) of DMD update cycles '31'-'34' respectively, DMD update cycle '35' being reserved for mirror testing. The fractional pixel luminance levels '1' to '4' may be combined to give any one of sixteen (including 'off') fractional luminance levels. Each of the sixteen fractional luminance levels may itself be combined with any one of pixel luminance levels '5' to '10' to give an increased number of possible pixel luminance levels—90 in this example, excluding 'off'. For a pixel of the highest available luminance, the respective mirror will be on for update cycles '0'-'30' of the 35 available DMD update cycles and for each of the fractional 'on' periods during update cycles '31'-'34'.

Under a known method for rendering an image, image data are generated on a frame-by-frame basis. For each 20 ms frame period 10, a required luminance level for each pixel needs to be known at the beginning of the frame period 10 as the luminance level will determine the pattern of modulation to be applied for the pixel in rendering that particular image frame.

In the present invention, a different approach has been devised for modulating DMD mirrors that is constrained neither by the fixed 20 ms frame-based rendering of an image of certain prior art systems, nor by the specific mirror modulation scheme shown in FIG. 1. The operating principles of this scheme of the present invention will now be described by way of example with reference to FIG. 2.

Figure 2:
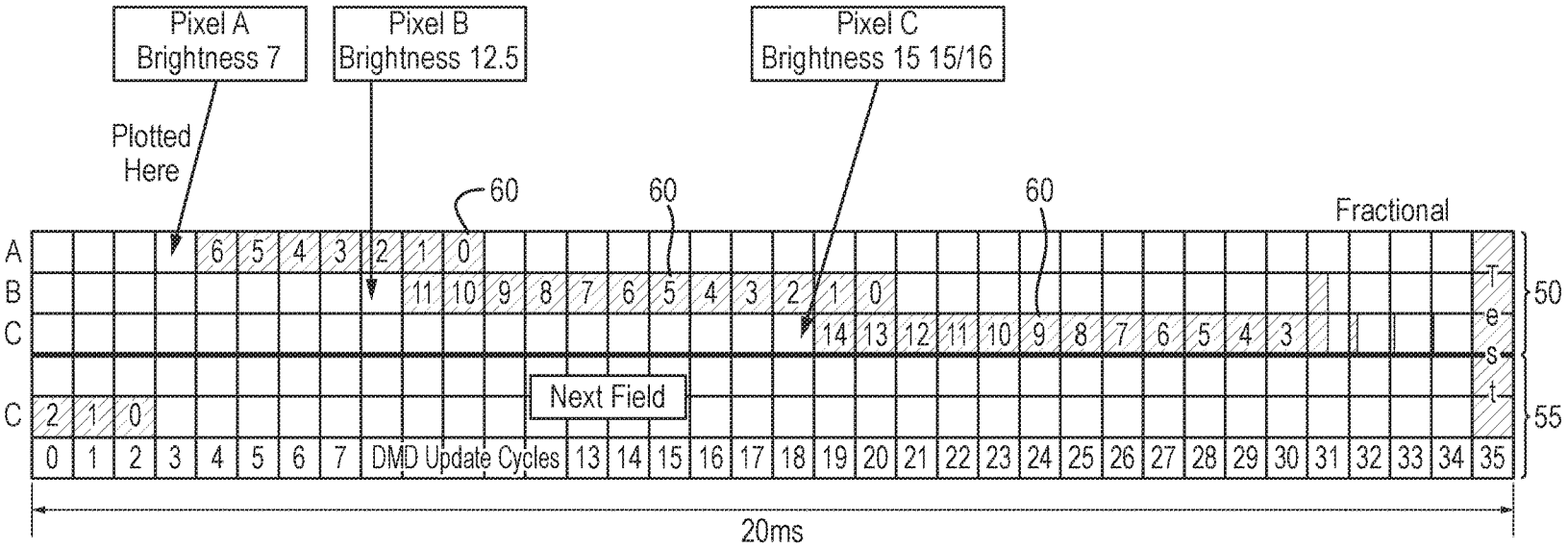
FIG. 2 shows a scheme for controlling the luminance of pixels in a DMD display according to one example embodiment of the present invention.

Referring to FIG. 2, example states of respective DMD mirrors for each of three pixels A, B and C are shown during each of DMD update cycles '0' to '34' of a nominal 20 ms period 50 and for Pixel C during the immediately following 20 ms period 55. FIG. 2 also shows the stored values 60 for a count-down timer store (the timer store itself not being shown in FIG. 2) associated with each pixel (DMD mirror) at the end of each DMD update cycle whose function will be clear from what follows.

If it is assumed, as shown in FIG. 2, that image data are received at the time of DMD update cycle '3' indicating that Pixel A is to be displayed with a luminance level '7', then the next available DMD update cycle following receipt of these data is DMD update cycle '4'. Under this scheme, luminance level '7' indicates that the respective DMD mirror is to be held in the 'on' state for 7 consecutive DMD update cycles beginning with the next available update cycle. The value '7' is written into a timer store associated with Pixel A before the first available DMD update cycle in which the pixel is to be illuminated. At the beginning of each DMD update cycle, if the value stored in the Pixel A timer store is non-zero, the DMD mirror for Pixel A is switched to or held in the 'on' state for that update cycle. The timer value is then decremented and the decremented value is stored in the Pixel A timer store ready for the next update cycle. The timer store value resulting at the end of each DMD update cycle is shown in FIG. 2.

As can be seen in FIG. 2, at the beginning of DMD update cycle '4', the timer store for Pixel A is read and, the value being non-zero, the pixel is illuminated during update cycle '4' and the store value is decremented from 7 to 6. At the beginning of update cycle '5', the timer value for Pixel A is read from the Pixel A timer store and, being non-zero, causes the DMD mirror for Pixel A to remain 'on' for update cycle '5'. The stored value is decremented to 5. This process continues until, after illuminating the pixel during update cycle '10', the timer value is decremented to zero. Therefore, at the beginning of update cycle '11', the timer value is zero and the Pixel A DMD mirror state is switched to 'off'.

Fractional values of pixel luminance may be implemented using, in this example, one or more of update cycles '31' to '34' to provide a 4-bit representation and implementation of one of 16 fractional luminance levels (including 'off'). Under this scheme: a luminance level of ½ is achieved by switching the DMD mirror to 'on' for half of the available illumination period during DMD update cycle '31'; a luminance level of ¼ is achieved by switching the DMD mirror to 'on' for one quarter of the illumination period during DMD update cycle '32'; a luminance level of ⅛ is achieved by switching the DMD mirror to 'on' for one eighth of the illumination period during DMD update cycle '33'; and a luminance level of 1/16 is achieved by switching the DMD mirror to 'on' for one sixteenth of the illumination period during DMD update cycle '34'. Different combinations of these four fractional illumination periods provide for the 15 possible fractional levels of pixel illumination.

The fractional illumination periods may of course be inserted at any position within a series of 36 DMD update cycles for the pixel according to the order chosen for driving the DMD device. The fractional update cycles may be retained either as a block of four, or distributed individually throughout the available DMD update cycles, in this example cycles 0 to 34 of a nominal 20 ms period comprising 35 DMD update cycles followed by one DMD test cycle.

In the example shown in FIG. 2, it can be seen that Pixel B needs to be plotted with a luminance level of '12%' beginning at the next available DMD update cycle—cycle '9' in this case. The integer value of luminance, in this case '12', is stored in the Pixel B timer store (not shown in FIG. 2) and the required fractional value is stored elsewhere to be recalled at one or more of update cycles '31' to '34', in this example at update cycle '31'. At DMD update cycle '9', the value in the Pixel B timer store is non-zero and so the Pixel B DMD mirror is switched to or is held in the 'on' state and the timer value is decremented to '11' and stored. The process repeats as for the Pixel A example, until in this case at update cycle '20', the timer value is decremented to zero so that at the beginning of update cycle '21', the timer value is zero and the Pixel B DMD mirror is switched to 'off'. At DMD update cycle '31', the first bit of the stored 4-bit fractional illumination value for Pixel B is recalled and, given that the first bit of the 4-bit value is set in this example to indicate that a ½ level illumination is required, triggers the illumination of Pixel B for one half of the available illumination period during DMD update cycle '31'.

In the example of FIG. 2, it can be seen that Pixel C not only requires a different fractional luminance value (15/16), one involving the use of the fractional illumination levels available in all four of DMD update cycles '31'-'34', i.e. a binary 4-bit fractional luminance value '1111', but also the illumination of the Pixel C DMD mirror for a period that spans two consecutive 20 ms periods, beginning at DMD update cycle '19' of the first period 50 and ending at update cycle '2' of the immediately following period 55.

The process operates as above for Pixel B, with the objective of inserting the fractional illuminations as soon as possible, in this example at the end of the first 20 ms period. The overlap into the next notional 20 ms period causes no operational difference in the process of decrementing the timer for Pixel C and switching the Pixel C DMD mirror. This is a particular advantage of controlling the DMD under the present invention, in that the concept of an image refresh period becomes largely redundant as all image updates take place beginning at the next available DMD update cycle following generation of the image update and for each of the pixels concerned, ends a number of update cycles later determined only by the required perception of pixel luminance by a viewer. It is required, in this example DMD modulation scheme, that the same scheme of modulation over a 20 ms period is applied in respect of all the pixels of an image as it is not generally practical to apply a particular fractional illumination period to different DMD micro-mirrors during different DMD update cycles: all pixels requiring a fractional illumination of ½ must receive that during the same DMD update cycle—'31' in the example. However, there is no difficulty assigning, for example, update cycle '27' to be the ½-cycle illumination period during each 20 ms period.

Whereas the illumination levels used in the example of FIG. 2 are defined in terms of the number of DMD update cycles or fractions of an update cycle during which as pixel is to be illuminated to achieve a required luminance level, it is conventional, for example when using an 8-bit video data signal, to define luminance as one of levels 0 to 255. A luminance level in the range 0-255 may be readily converted into a luminance level as used in FIG. 2 by considering each of the DMD cycles in which the pixel is fully illuminated as contributing a luminance weighting of '8'. The fractional luminance levels in the scheme used in FIG. 2 would then contribute the following weightings:

½ cycle illumination as a weighting of 4;

¼ cycle illumination as a weighting of 2;

⅛ cycle illumination as a weighting of 1; and

1/16 cycle illumination as a weighting of ½.

This provides for any one of illumination levels 0 to 255%. A conversion process may therefore readily be implemented to convert a luminance level in the range 0-255 to a 9-bit binary number as may be used to control DMD mirror switching according to the scheme described above with reference to FIG. 2 and in more detail below.

One example functional implementation of the present invention will now be described with reference to FIGS. 3 and 4, each providing a functional representation of the operational elements of a display system based upon a DMD and implementing the principles described by way of example above.

Figure 3:
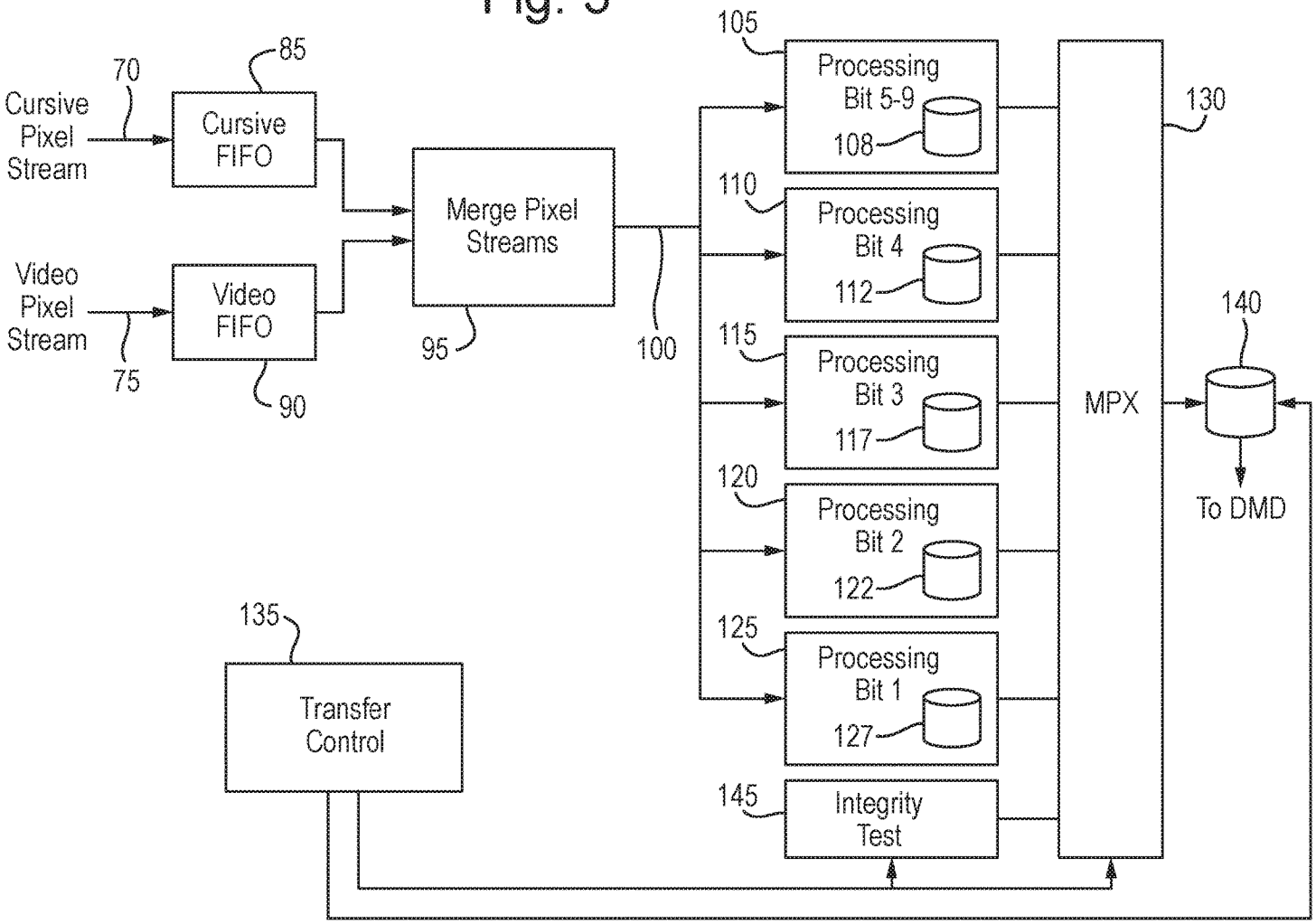
FIGS. 3 and 4 show functional block diagrams of the processing and data storage features in one example implementation of the present invention.

Referring firstly to FIG. 3, a high level functional block diagram is provided showing how the processing of pixel luminance values may be organised from receipt of generated image data, comprising luminance data for one or both of a Cursive Pixel Stream 70 and a Video Pixel Stream 75, to output of data 80 for controlling a DMD (not shown in FIG. 3). It is assumed for the purposes of this example embodiment that the input luminance values for each pixel are represented as a 9-bit binary number according to a predetermined scheme for driving the DMD. One reason for using a 9-bit representation (0-511) rather than an 8-bit representation of video data is to help to maintain a desirable number of distinct pixel luminance levels in the event that a 'gamma correction' is applied to one or more regions of the image to be displayed. If an 8-bit representation were to be used there is an increased risk that distinct luminance levels in the input video data would, after gamma correction at the 8-bit level, no longer be distinct. It is also known to use more than 9 bits to encode video data for this reason, but for the purposes of this example embodiment of the present invention, a 9-bit representation will be assumed.

In conjunction with respective buffering FIFOs 85, 90, a processing block 95 is arranged to merge the input image data streams 70, 75 to form a single data stream 100, optionally including flags generated to identify whether the data defining luminance of a pixel relates to a cursively drawn feature in the image or to a pixel in a video data stream. The inclusion of such flags enables priority to be given in later processing steps to data defining pixels that are part of a cursively drawn symbol over data defining video pixels when determining how to update the image during the immediately following DMD update cycle or cycles.

The pixel luminance data in the combined data stream 100 are stored in a memory device associated with each of an arrangement of processing modules 105 to 125, arranged in this embodiment to split the processing of image data for DMD update cycles 0 to 30 from that for DMD update cycles 31 to 34. The first Processing module 105 is arranged to process bits 5 to 9 of each 9-bit pixel luminance value and the processing modules 110, 115, 120 and 125 are each arranged to process one of bits 1 to 4 of the pixel luminance value.

The Processing module 105 is arranged to store bits 5-9 of the received pixel luminance data in an associated memory device 108. In a typical image of 1280×1024 pixels, the memory device 108 is arranged to store bits 5 to 9 for each of the 1310720 pixels in the image. Bits 5 to 9 represent the number of DMD update cycles during update cycles 0 to 30 of an image refresh period during which the respective DMD mirror is required to be 'on' for the entire available illumination period during the update cycle for a given pixel. Each of the Processing modules 110, 115, 120 and 125 is provided with access to a respective memory device 112, 117, 122 and 127 for the storage of bits 4, 3, 2, and 1 of the 1310720 pixels, in this example of a 1280×1024 pixel image. Data bits 4, 3, 2, 1 define whether a DMD mirror is to be switched 'on' for a respective portion of DMD update cycles 31, 32, 33 and 34, providing any one of 16 fractional luminance levels, including 'off'.

The processing capability provided within each of the modules 105, 110, 115, 120 and 125 implements a predetermined scheme for the update of an image using the received data 100. The processing module 105, in particular, implements elements of the scheme described above with reference to FIG. 2 for determining a pixel timer value to be stored—'plotted'- and decremented for each pixel in the memory 108 at each DMD update cycle, as will be described in more detail below.

A Multiplexer (MPX) module 130 is provided to read data from the memory devices 108, 112, 117, 122 and 127 associated with the processing modules 105, 110, 115, 120 and 125 under timing controls determined by a Transfer Control module 135 and to generate bit-planes of data, according to a predetermined DMD driving scheme, to be transferred to a memory device (DMD Buffer) 140 associated with the DMD. Each bit-plane of data defines which of the DMD mirrors (pixels) are to be illuminated during a respective DMD update cycle. Thus, for DMD update cycles 0 to 30, the MPX module 130 would be triggered by the Transfer Control module 135 to read data from the memory device 108 associated with the Processing bits 5 to 9 module 105 to drive the DMD; for DMD update cycle 31, the MPX module 130 would be triggered to read data from the memory device 112 associated with the Processing bit 4 module 110, etc. The writing of pixel data into the memory devices 108, 112, 117, 122, 127 is inhibited by the Transfer Control module 135 during periods of transfer of bit-plane data from those memory devices to the DMD Buffer 140. During this time the pixels waiting to be plotted may be stored in their respective FIFOs 85, 90.

Once the pixel data are plotted (loaded) into the memory devices 108, 112, 117, 122, 127 by the Processing modules 105, 110, 115, 120 and 125, their processing is triggered by the Transfer Control module 135 on respective update cycles of the DMD. The Transfer Control module 135 provides the update timing of the system throughout each 20 ms period. It times the gap between each DMD update; it counts the update cycles to determine which of the memory devices 108, 112, 117, 122, 127 should be selected for transfer of data to the DMD. It also provides the addressing to transfer every pixel from the memory devices 108, 112, 117, 122, 127 to the DMD Buffer 140 and thus to the DMD. DMD Integrity Testing 145 may be triggered to take place during DMD update cycle 35, for example, or it may be triggered to take place during any DMD update cycle within the time interval defined by the image refresh period.

The functionality of the Processing modules 105, 110, 115, 120, 125 and of the MPX module 130 dedicated to processing bits 5-9 and bits 1, 2, 3 and 4 of a received pixel luminance value will now be described in more detail with reference to FIG. 3 and additionally with reference to FIG. 4. Those features that are common to both FIG. 3 and FIG. 4 are labelled using the same reference numerals.

Figure 4:
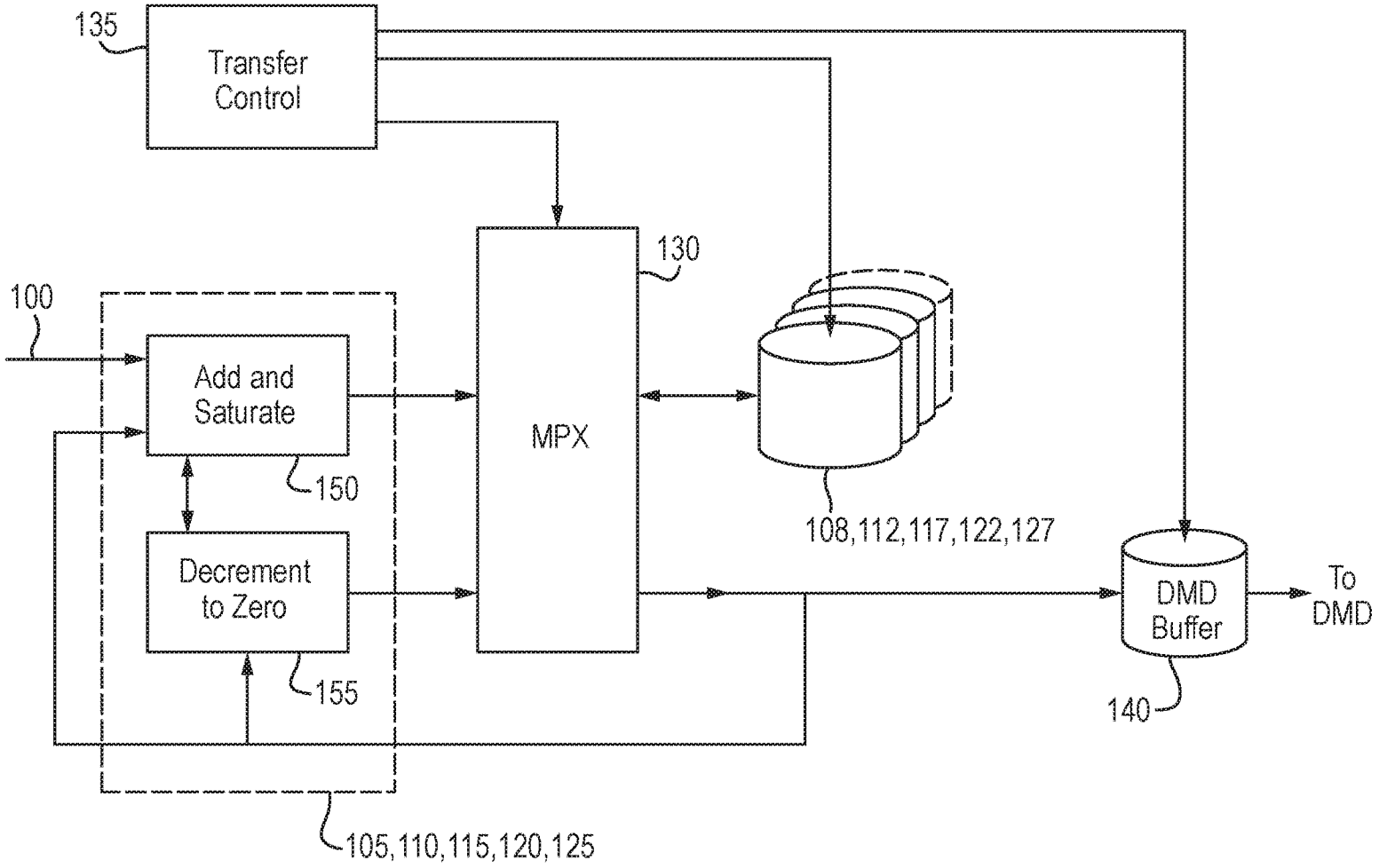

Referring additionally to FIG. 4, a functional block diagram is provided showing the functional features required to process a pixel luminance value and to control the respective DMD mirror over DMD update cycles 0 to 34 to achieve a perception of the pixel luminance represented by the value in those bits. In particular, FIG. 4 shows how functions of the Processing modules 105, 110, 115, 120, 125 and of the MPX module 130 interoperate to generate and output data for each pixel to the DMD Buffer 140 and so determine the state of a respective DMD mirror during each of DMD update cycles 0 to 34.

In respect of bits 5 to 9 of pixel luminance values, the Transfer Control module 135 triggers the MPX module 130 to read pixel data from the memory 108 for those pixels of the image to be updated. For bits 1 to 4, the Transfer Control module 135 triggers the MPX module 130 to read pixel data from the memories 112, 117, 122 and 127 respectively for those pixels of the image to be updated. The processing modules 105, 110, 115, 120, 125 implement an Add and Saturate function 150, arranged to receive pixel data from the combined data stream 100 for the pixel and to implement a predetermined scheme for combining any 'cursive' (70) or 'video' (75) pixel data defined therein with a luminance value for the most recent DMD update cycle read from the respective memory 108, 112, 117, 122, 127 and so determine what luminance value should be used from the next DMD update cycle to update that pixel in the image according to known blending functions. The processing modules also implement a Decrement to Zero function 155 arranged to decrement a luminance value read from the respective memory and to output the new value for storage by the MPX module 130 in the same memory location. However, in respect of the luminance contribution by bits 5 to 9, rather than decrementing the luminance value through a simple subtraction by 1 or by another integer, a different form of 'decay' may be applied to the pixel luminance value, for example multiplication of the currently stored value by a fraction, or application of an exponential reduction scheme to the pixel luminance value represented by bits 5 to 9.

Under one example scheme for combining received image data 100 with currently stored pixel luminance levels, the Add and Saturate function 150 may arrange to add bits 5 to 9 of a new pixel luminance value 100 to the currently stored luminance value read from the memory 108 or, if greater than the currently stored luminance value, it may replace the currently stored luminance value for output to the MPX module 130 and storage in the memory 108. If the sum of the current luminance value and the new pixel luminance value exceeds 31, corresponding to full illumination of the next 31 DMD update cycles that may be controlled by bits 5 to 9 of the pixel luminance value, the value '31' is written into the pixel store in the memory 108. If the newly received pixel luminance data includes luminance values for both a cursive update and a video update to the image, then the Add and Saturate function 150 may be arranged to give priority to the luminance value for the cursive update over that for the video update when determining the luminance value to be added to or to replace the currently stored pixel luminance in the memory 108, in particular if the cursive luminance value is greater than the video update luminance value for the pixel.

A pixel luminance level defined by bits 5 to 9 is achieved using the method described above with reference to FIG. 2 in which the pixel is illuminated (DMD mirror is switched to 'on') for as long as the pixel luminance value read from the memory 108, remains non-zero. As can be seen in FIG. 4, each time a pixel luminance value is read from the memory 108 for transfer by the MPX module 130 in a respective bit-plane to the DMD Buffer 140, the value is also returned for processing by the Add and Saturate function 150 according to the schemes described above, to be combined with newly received image data 100, or to be decremented by the Decrement to Zero function 155 before output to the MPX module 130 and storage in the memory 108 for use in the next DMD update cycle. The Transfer Control module 135 is arranged to inhibit all plotting of new pixel data into the memory 108, 112, 117, 122, 127 while the contents of the memory are being read as a bit-plane of data and transferred to the DMD Buffer 140.

The functionality of each of the second to fifth processing modules 110-125, dedicated to processing bits 4, 3, 2, and 1 of a pixel luminance value respectively, is generally similar to that described above for bits 5 to 9, except of course that the bit values in positions 1 to 4 each represent only a single DMD update cycle and the Decrement to Zero function 155 operates trivially to permit only a single update cycle to be influenced by the respective bit value for a pixel, unless replaced by the Add and Saturate function 150 based upon newly received data for the pixel. For each of DMD update cycles 31-34, the Transfer Control module 135 triggers the MPX module 130 to read pixel data from the memories 112, 117, 122, 127 respectively when assembling the bit-planes of data for transfer to the DMD Buffer 140 for the fractional luminance levels. For bits 1 to 4, the Add and Saturate function 150 operates an equivalent scheme to that for bits 5 to 9, but at the level of fractional additions or replacements and the setting or resetting of respective bits 1 to 4 based upon the received image data 100, as would be apparent to a notional skilled person in this field. The Transfer Control module 135 is arranged to inhibit plotting of fractional illumination of pixels into the memories 112, 117, 122, 127 while the latest bit-plane of data for any of update cycles 31 to 34 is being assembled and transferred to the DMD Buffer 140.

A DMD driving scheme based upon 35 DMD update cycles within a 20 ms image refresh period, as described by way of example above, may of course be varied according to the switching speed of the DMD device and the speed of the data bus and processing modules associated with it. For example, future devices may be able to support the use of 256 DMD update cycles of approximately 78 μs within each 20 ms 'image refresh' period. A received pixel luminance value in the range 0-255 may then be used directly as a timer value defining the number of 78 μs update cycles during which the pixel is to be illuminated, providing for a simplification in the processing functionality described above with reference to FIG. 4 as the fractional illumination levels would no longer be required.

One alternative DMD driving scheme that may be implemented in an example embodiment of the present invention using the best devices currently available makes use of 63 DMD cycles of full pixel illumination and 3 fractional cycles per 20 ms period, rather than the 31 cycles of full illumination and 4 cycles of fractional illumination as described above. Such a scheme may be readily implemented using a corresponding arrangement of the apparatus described above with reference to FIGS. 3 and 4 as would be apparent to a notional skilled person in this field. Similarly, a DMD driving scheme may be implemented based upon a smaller number of DMD update cycles per image refresh period, for example using 15 cycles of full pixel illumination and 5 cycles of fractional illumination according to another example embodiment of the present invention.

In another example embodiment of the present invention, a different approach may be taken to the method for controlling the period for which a pixel is to remain 'on'. As an alternative to using a count-down timer store for each pixel, an arrangement may be implemented involving the use of a shift register associated with each pixel. Although the use of a shift register requires more memory than a count-down timer store, constraints associated with memory capacity would be expected to reduce in future display devices. In this embodiment, a shift register may be implemented in memory for each pixel, the shift register having a bit-length equal to the number of DMD update cycles in a 20 ms period. If a pixel is to be illuminated for a given number of DMD update cycles, the shift register may be filled with that given number of 1 s as a contiguous string, the remaining bit positions being set to or remaining at 0. The bits in the shift register are shifted along one bit position at the beginning of each update cycle and the emerging value read. Therefore, the position within the shift register at which the one or more is are written determines at which DMD update cycle in the future the respective pixel will be switched 'on'. The number of 1 s written into the shift register starting at that position determines the number of DMD update cycles for which, when the bits are shifted, a 1 emerges from the register and the pixel will be or remain illuminated.

To enable the shift register to be updated in time for the update to take effect at any selected DMD update cycle in the future, a parallel loading shift register may be provided for each pixel so that updates to its content may be made at any bit position within the register at any time (other than when the register is being shifted) under the control of processing functionality as described above with reference to FIGS. 3 and 4. In particular, the arrangement of 1 s in the shift register may be updated in response to a result of applying any of the example methods described or mentioned above for determining how an update to an image at a given DMD update cycle will affect the illumination of a pixel.

Whereas example embodiments of the present invention have been described above in the context of a DMD device, the same techniques may be applied to the control of other types of digital display device, for example liquid crystal display (LCD) devices, with appropriate modifications of the display driver functionality and electronics to ensure that an appropriate pattern of modulation may be applied to the display device during an image refresh period to achieve the required distribution of pixel illumination. In particular, a notional cycle of 'full' pixel illumination for an LCD display device may comprise a period during which the pixel is illuminated, followed by a period of equivalent length during which the pixel is not illuminated in order to satisfy the device requirements for so-called 'pixel balancing', all within the equivalent of a DMD update cycle or at least within the time period defined by the 20 ms 'image refresh' period, as is usual for display devices based upon liquid crystal material. However, the overall determination of a pattern of modulation based upon a count-down timer, shift register or other memory arrangement, as in example embodiments of the present invention described above, may still be applied to the control of LCD and other digital display device types with corresponding modification to the final implementation of 'full' or fractional illumination of a pixel at the display device.

The invention claimed is:

1. A method for controlling a digital display device to display an image, by which method a perceived luminance level for a plurality of pixels in an image to be displayed is achieved, the method comprising:

controlling a respective element of the display device to illuminate a first pixel for a first predetermined portion of an image refresh period, said first predetermined portion being indicated by the content of a first store provided in respect of the first pixel; and controlling a respective element of the display device to illuminate a second pixel for a second predetermined portion of the image refresh period, said second predetermined portion being indicated by the content of a second store provided in respect of the second pixel, the content of the second store being different than the content of the first store, wherein the content of the first store and the second store represents a number of discrete display device update cycles of predetermined length within the image refresh period for the respective pixel during which the respective pixel is to be illuminated such that the respective pixel is illuminated for said respective predetermined portion of the image refresh period, wherein the content of the respective store at each update cycle determines whether the respective pixel is to be illuminated or not illuminated for that update cycle and the content of the respective store is updated at each update cycle for which the respective pixel is illuminated to indicate that the number of update cycles for which the respective pixel is to be illuminated is reduced by one, and wherein one or more of the display update cycles is designated to illuminate a respective pixel for only a portion of each of the one or more display update cycles, and wherein the content of the first store or second store determines which of the one or more of the display update cycles to use for the first pixel or the second pixel, respectively.

2. The method according to claim 1, wherein four or more update cycles during an image refresh period for a respective pixel are reserved for the illumination of the respective pixel for a different respective portion of the update cycle, the four or more update cycles providing fractional levels of pixel luminance.

3. The method according to claim 1, wherein the respective store comprises a count-down timer value store for the respective pixel defining the number of update cycles for which the respective pixel is to be illuminated and wherein updating the respective store at each update cycle comprises decrementing the stored time value for the respective pixel such that when the stored value reaches zero, the respective pixel will no longer be illuminated.

4. The method according to claim 1, wherein the respective store comprises a shift register for the respective pixel, each shift register of a bit-length equal to the number of update cycles in the image refresh period for the respective pixel, wherein the number of update cycles for which the respective pixel is to be illuminated is indicated by the number of bits set in the shift register, and wherein updating the respective store at each update cycle comprises shifting the bits in the shift register by one position such that when a bit is read from the shift register, the respective pixel will be illuminated if the bit is set, or otherwise the respective pixel will no longer be illuminated.

5. The method according to claim 4, wherein any bit of the shift register is updated at any update cycle in response to received image data causing an update to the required luminance level for the respective pixel.

6. A digital display system, comprising:

a digital display device for displaying an image; and a display controller arranged to control the digital display device to display pixels in an image at a required level of luminance by controlling a respective region of the digital display device to illuminate a first pixel for a respective first portion of an image refresh period and a second pixel for a respective second portion of the image refresh period, wherein the display controller includes an input for receiving image data defining luminance levels for the first and second pixels;

a processor arranged with access to a first store and a second store provided for the first pixel and the second pixel, respectively, the processor configured to receive image data from the input defining a required luminance level for each of the first and second pixels, store in the respective store provided for the respective pixel content that indicates a number of discrete display device update cycles of predetermined length within the image refresh period for the respective pixel during which the pixel is to be illuminated such that the respective pixel is illuminated for a portion of the image refresh period corresponding to the required luminance level for the respective pixel, wherein each of the first and second pixels is illuminated for a portion of an update cycle during the image refresh period for the respective pixel, and wherein the content of the respective store further indicates an update cycle that is designated for illuminating the respective pixel for only a portion of the update cycle, read the content of the respective store for each respective pixel at each update cycle and generate an output to indicate which pixels are to be illuminated for the update cycle and which are not to be illuminated, in dependence upon the content of the respective pixel stores, wherein the content of the first store is different than the content of the second store, and update the content of the respective store for each respective pixel at each update cycle for which the respective content indicates that the respective pixel is to be illuminated to indicate that the number of update cycles for which the respective pixel is to be illuminated is reduced by one.

7. The system according to claim 6, wherein four or more update cycles during an image refresh period for a respective pixel are reserved for the illumination of the respective pixel for a different respective portion of each of the one or more update cycles, the four or more update cycles providing fractional levels of pixel luminance.

8. The system according to claim 6, wherein the respective store comprises a count-down timer value store for each respective pixel defining the number of update cycles for which the respective pixel is to be illuminated and wherein updating the respective store at each update cycle comprises decrementing the stored time value for the respective pixel such that when the stored value reaches zero, the respective pixel will no longer be illuminated.

9. The system according to claim 6, wherein the respective store comprises a shift register for each respective pixel of bit-length equal to the number of update cycles in the image refresh period for the respective pixel, wherein the number of update cycles for which the respective pixel is to be illuminated is indicated by the number of bits set in the shift register, and wherein updating the respective store at each update cycle comprises shifting the bits in the shift register by one position such that when a bit is read from the shift register, the respective pixel will be illuminated if the bit is set, or otherwise the respective pixel will no longer be illuminated.

10. The system according to claim 9, wherein the processor is arranged with access to update any bit of the shift register at any update cycle in response to received image data causing an update to the required luminance level for the respective pixel.

11. A digital display device incorporating or associated with a controller arranged to implement the method according to claim 1.

12. A digital display device controllable according to the method defined in claim 1.

13. The system according to claim 6, wherein the output of the display controller includes or is operatively coupled to a multiplexor.

14. The system according to claim 6, wherein the output of the display controller includes or is operatively coupled to a multiplexor operatively connectable to a buffer associated with the digital display device.

15. The system according to claim 6, wherein the output of the display controller includes or is operatively coupled to a pixel driver circuit.

16. The system according to claim 15, wherein the pixel driver circuit is a digital micro-mirror device (DMD) driver.

17. The method according to claim 1, wherein the content of the respective store is updated at any update cycle to implement an update to the luminance level required for the respective pixel in response to received image data.

18. The system according to claim 6, wherein the processor is further configured to update the content of the respective store at any update cycle to implement an update to the luminance level required for the respective pixel in response to received image data.

* * * * *